US006322482B1

(12) United States Patent
Kim

(10) Patent No.: US 6,322,482 B1
(45) Date of Patent: Nov. 27, 2001

(54) KICK TRAINING BELT

(76) Inventor: Jeong Se Kim, 1763-3 Singdang-dong, Dalseo-ku, Daegu (KR)

( * ) Notice: Subject to any disclaimer, the term of this patent is extended or adjusted under 35 U.S.C. 154(b) by 0 days.

(21) Appl. No.: 09/593,364

(22) Filed: Jun. 14, 2000

(51) Int. Cl.[7] ..... A63B 21/02
(52) U.S. Cl. ..... 482/124; 482/121; 482/126
(58) Field of Search ..... 482/909, 124, 482/121, 126, 130, 148; 428/192, 193, 194; 473/458; 128/869, 876

(56) References Cited

U.S. PATENT DOCUMENTS 4,846,459 * 7/1989 Vivian ..... 482/909
5,372,565 12/1994 Burdenko ..... 482/124
5,614,300 * 3/1997 Cicali et al. ..... 482/122
5,807,218 * 9/1998 Nagatoma ..... 482/124

* cited by examiner

*Primary Examiner*—Jerome Donnelly
(74) *Attorney, Agent, or Firm*—Marquerite Del Valle

(57) ABSTRACT

A kick training belt for use in martial arts training exercises includes an adjustable elastic body, binding tools at both ends thereof, and air tubes in the binding tools which are inflated upon securing the belt to a trainee's limbs, so as to cushion and protect the limbs from accidental injury and prevent the elastic body from constricting blood flow to the limbs. The binding tools are secured to the trainee's limbs via hook and loop fasteners, which can also be used to connect two or more kick training belts end-to-end. Auxiliary strips having complementary hook and loop fasteners engage the kick training belt, and can be used to removeably attach auxiliary exercise equipment thereto, including knee pads, sand bag weights and athletic handles. A counting device engages the kick training belt to record the number of exercise repetitions a trainee has completed during a session.

4 Claims, 6 Drawing Sheets

PRIOR ART

KICK TRAINING BELT

BACKGROUND OF THE INVENTION

1. Field of the Invention

This invention relates to training equipment for martial arts such as Taekwondo, and more particularly, to a kick training belt which is made from an elastic material such as rubber, and includes a length adjuster, a counter, and cuffs having inflatable air tubes.

2. Description of the Prior Art

In the past, to improve one's strength training and kick accuracy in martial arts such as Taekwondo, one had to work with a partner, using a kick training board. When partners trained in a pair, one trainee would adjust the height of the kick training board and hold it while the other would kick the board repeatedly to learn the accurate kick technique.

However, as above, the method whereby one holds a kick training board and a trainee kicks the board the trainee can inflict a wound upon the hand or the wrist of the person holding the board by accident, and the trainee can also be injured thereby. Besides, the method is effective for exercising the kick but it has no strengthening effect on the lower muscles of the body which is a basic condition for developing an effective kick. Those are problems.

To solve the problems as above, this applicant has described the kick training belt in Korean Utility Model Application No. 1998-14172 as shown in FIG. 1, wherein the binding tools 2 of a band type are attached at both ends of the rubber elastic belt 1 by the binding means 3. The binding tools 2 have hook and loop fasteners 4, 4' for securing to the limbs of the wearer, where one binding tool is worn on the ankle of the trainee and the other is worn on the hand or the ankle of his or her partner, thereby helping to prevent injuries during training. The belt is advantageous because the muscles of the lower body of a body can be strengthened, there is no worry about the damage in using the belt, and the belt can be manufactured at small outlay.

However, the above kick training belt is limited in that its length is that of the elastic belt so that it can not be adjusted appropriately for the given body condition or the training circumstance. Also the binding tool is constricts the limb it is worn on, causing discomfort and pain. Furthermore, one cannot use auxiliary training devices such as knee pads, sand bag weights or athletic handles with the above kick training belt, and it also lacks any system for relieving the trainee of counting his or her repetitions, imposing an inconvenience and creating a distraction.

SUMMARY OF THE INVENTION

As the present invention is designed to solve the problems as above, the object of the invention is to provide a kick training belt. The elongate body of the belt material, such as rubber. A binding tool engages each of both ends of the body of the belt, each having hook and loop fasteners (VELCRO) thereon. The binding tools are made of inflatable air tubes, into which air can be injected to cushion and protect the limbs of the wearer during use. The body of the kick training belt also includes a sliding buckle member for adjusting the length thereof, and a counter for recording the number of repetitions of a specific training exercise. Furthermore, the structure of the kick training belt of the present invention allows the use of auxiliary training devices such as knee pads, sand bag weights, or athletic handles to enhance the training session.

BRIEF DESCRIPTIONS OF THE DRAWINGS

Figure 3A:
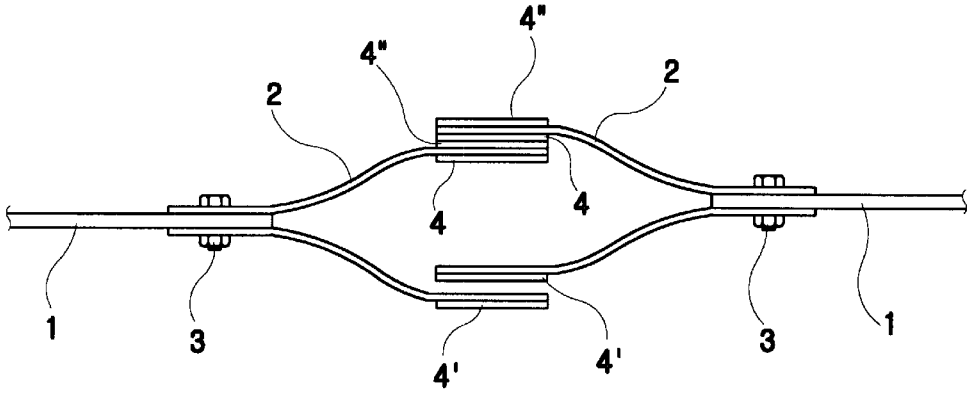

FIG. 3*a* is a top view of two kick training belts according to the present invention, shown interconnected.

Figure 3B:
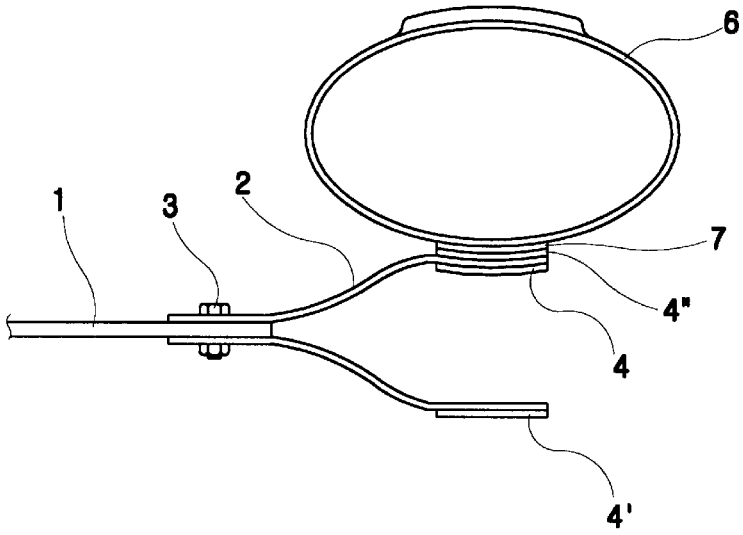

FIG. 3*b* is a top view of the kick training belt of the present invention, shown engaging an auxiliary knee pad.

Figure 3C:
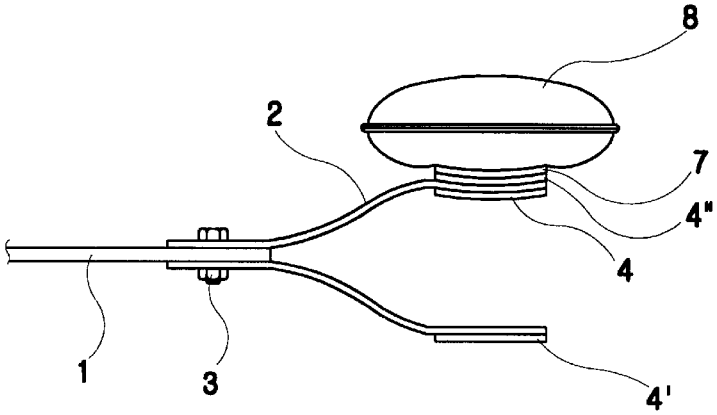

FIG. 3*c* is a top view of the kick training belt of the present invention, shown engaging an auxiliary sand bag weight.

Figure 3D:
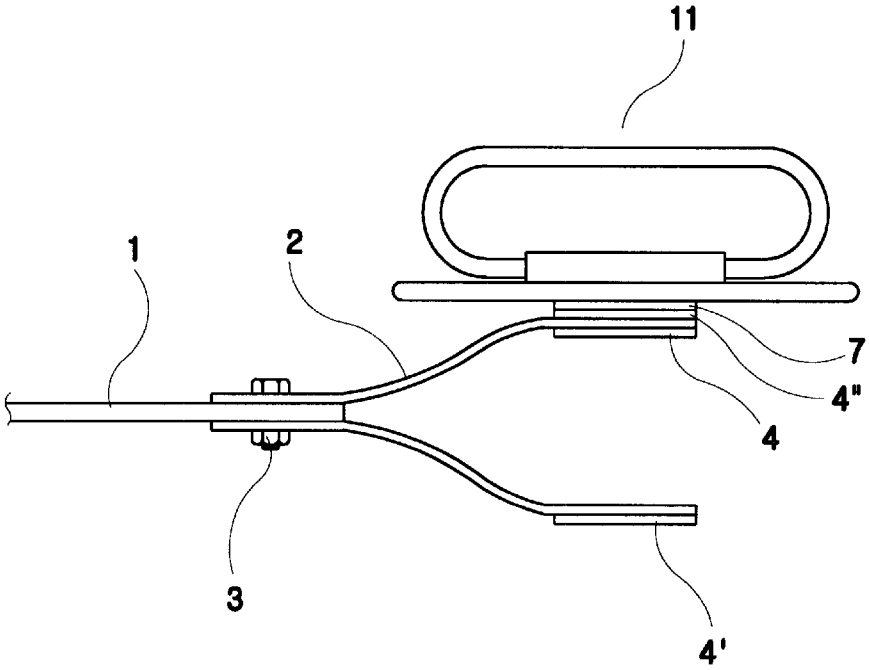

FIG. 3*d* is a top view of the kick training belt of the present invention, shown engaging an athletic handle.

Figure 4:
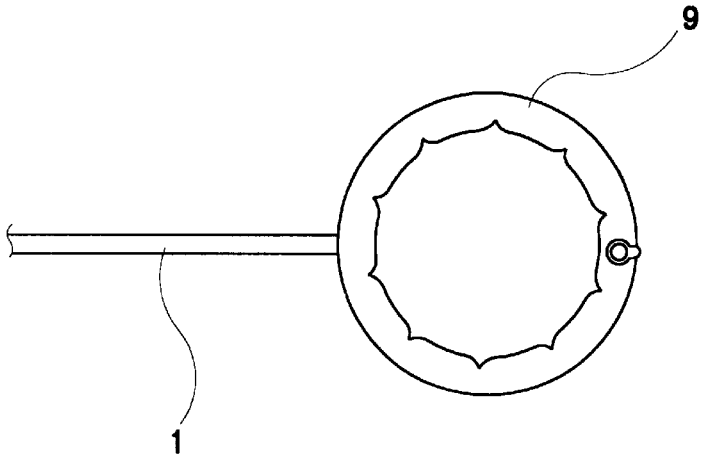

FIG. 4 is a top view of the kick training belt of the present invention, shown with the air tube of the binding tool inflated.

Figure 5:
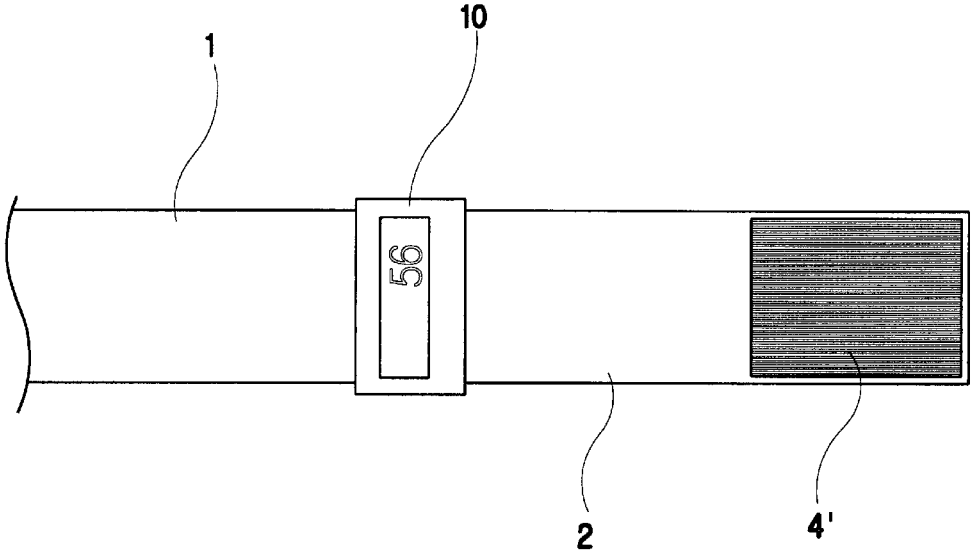

FIG. 5 is a side view showing the belt having a counter according to the present invention.

Figure 6:
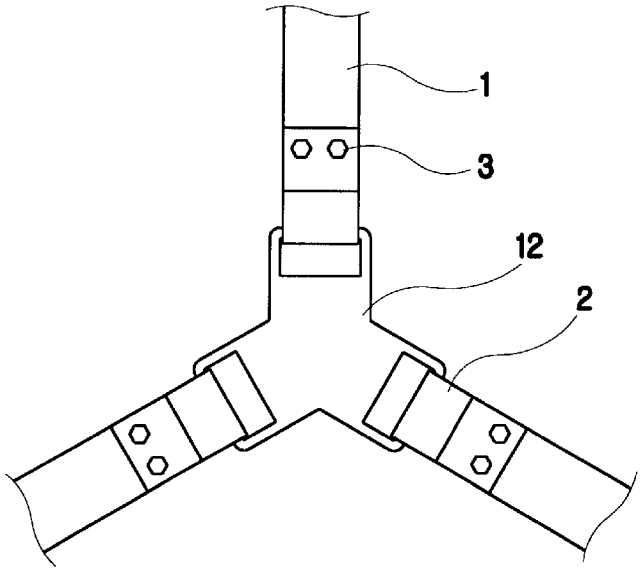
Figure 6:
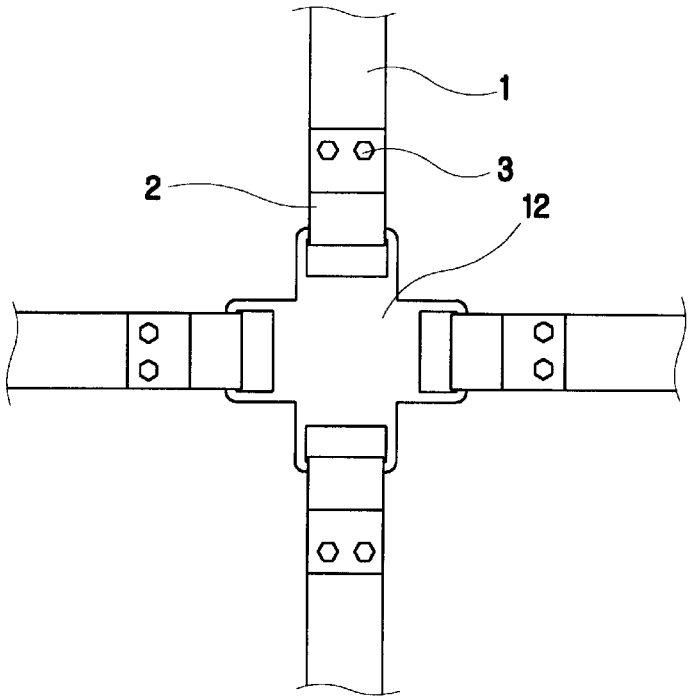

FIG. 6 is a top view of multiple kick training belts of the present invention, shown interconnected.

DESCRIPTION OF THE PREFERRED EMBODIMENT

The preferred embodiments of the present invention will be described in more detail referring to the attached drawings as below.

Figure 1:
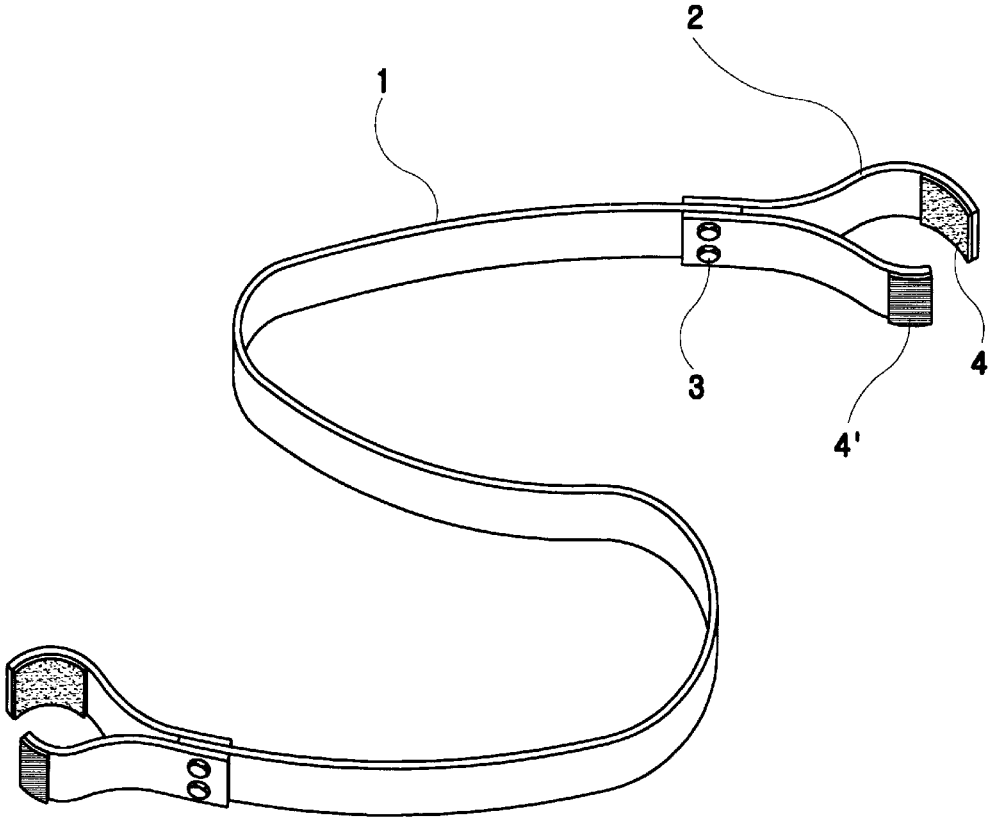
FIG. 1 is a perspective view of a traditional kick training belt as in the prior art.
Figure 2:
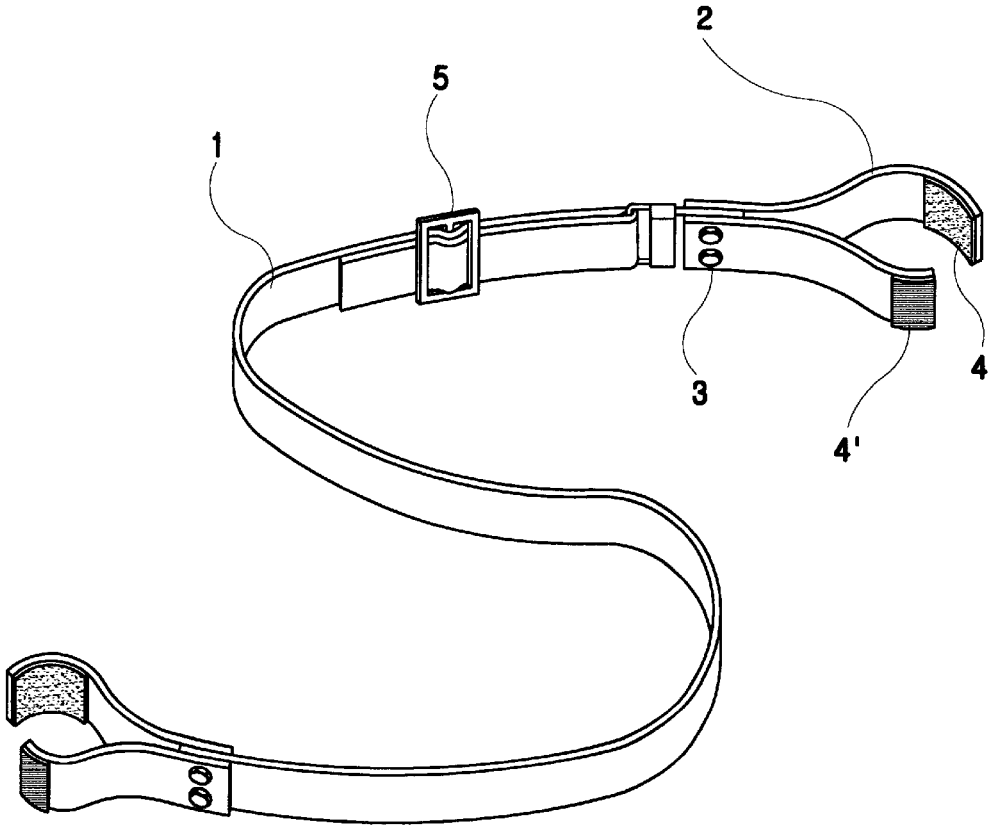
FIG. 2 is a perspective view of the kick training belt of the present invention.

Referring now to FIG. 2, the preferred embodiment of the kick training belt of the present invention comprises an elongate body 1 fabricated from an elastic material, such as rubber. Connection means 3 secure each of a pair of binding tools 2 to the opposing ends of body 1. Each of binding tools 2 comprises two adjoining inflatable air tube members, into which air can be injected to cushion and protect the limbs of the wearer during use. Both members of binding tools 2 have hook and loop fasteners (VELCRO) 4, 4' thereon to engage each other to secure binding tools 2 to the limbs of a wearer. Body 1 of the kick training belt also includes a sliding buckle member 5 for adjusting the length thereof. Sliding buckle member 5 allows one to change the length of the kick training belt to better accommodate both the dimensions of his or her body and the movements of the specific martial arts exercise.

Referring now to FIGS. 3*a*–3*d*, the kick training belt of the present invention is able to incorporate many auxiliary exercise devices, via hook and look fasteners 4, 4' of binding tools 2. FIG. 3*a* illustrates how two kick training belts can interconnected end-to-end. The hook and loop fasteners 4, 4' of a second kick training belt engage an auxiliary strip 4" having hook and loop fasteners, which in turn engage the complimentary hook and loop fasteners 4, 4' of the first kick training belt, to create a "chain" of kick training belts. Depending on the circumstance, this chain can comprise any number of kick training belts. FIG. 3*b* illustrates the use of the kick training belt with an auxiliary knee pad 6. Knee pad 6 has hook and loop fasteners 7 thereon, which engage the complimentary hook and loop fasteners of auxiliary strip 4", which in turn engage the complimentary hook and loop fasteners 4, 4' of the kick training belt. FIG. 3*c* illustrates the use of the kick training belt with an auxiliary sand bag weight 8. Sand bag weight 8 has hook and loop fasteners 7 thereon, which engage the complimentary hook and loop fasteners of auxiliary strip 4", which in turn engage the complimentary hook and loop fasteners 4, 4' of the kick training belt. FIG. 3*d* illustrates the use of the kick training belt with an auxiliary athletic handle 11. Athletic handle 11 has hook and loop fasteners 7 thereon, which engage the complimentary hook and loop fasteners of auxiliary strip 4", which in turn engage the complimentary hook and loop fasteners 4, 4' of the kick training belt.

Now referring to FIG. 4, the air tubes 9 of binding tools 2 are inflated with air. The inflated air tubes work to cushion and protect the limbs of the user during use. Often the limbs of one training in martial arts become tired and sore during the training session. The inflatable air tubes 9 of binding tools 2 function as a cuff for greatly reducing the stress and tension on the limb incurred by stretching, pulling or repetitive movement while using the kick training belt. Furthermore, the pliable material of air tubes 9 make binding tools 2 more comfortable, and does not constrict blood flow to the limbs wearing the kick training belt during training.

Furthermore, FIG. 5 illustrates the counter device 10 of the kick training belt, for recording the number of repetitions of a specific training exercise. In the preferred embodiment of the invention, counter device 10 is installed between body 1 of the kick training belt and binding tool 2, so as to facilitate visibility, so that one can confirm the number of training exercise repetitions by eye.

In addition to an end-to-end "chain" formation, multiple kick training belts of the present invention can be used together as shown in FIG. 6. Here, a multidirectional connecting tool 12, with alternatively three or four apertures for receiving binding tools 2, allows training exercises to be performed by multiple trainees together.

Hereinafter, the action of this invention constituted as above will be described.

When the kick training belt of this invention is used for kick training, the binding tool 2 connected to the elastic body 1 is worn to the ankle of the trainee. Hook and loop fasteners 4, 4' are interconnected once binding tool 2 circumferentially engages the ankle of the trainee, to secure it thereto. Therefore, it can be used more conveniently.

The trainee wears the one binding tool 2 of while the opposing binding tool 2 is worn on the ankle of another trainee for training together or on a body part of the assistant supporting the trainee during the session.

On the other hand, as shown in FIG. 3, auxiliary strips 4" have hook and loop fasteners that engage the hook and loop fasteners 4, 4' of binding tool 2. Auxiliary strips 4" allow trainees to connect two or more kick training belts end-to-end in a "chain" formation. Auxiliary strips 4" also facilitate the use of knee pads 6 to further protect the trainee. Furthermore, auxiliary strips 4" allow the trainee to incorporate sand bag weights 8 and athletic handles 11, to enhance the training session by strengthening muscles and conditioning the upper limbs as well as the lower limbs.

The kick training belt of the present invention includes features, as described above, that improve the safety and quality of martial arts training sessions, reducing accidental injuries and providing a hook and loop system for removably attaching the kick training belt to the limbs of the trainee, to other kick training belts and to a variety of auxiliary training equipment. In addition, the kick training belt of the present invention includes a counting device and an adjustable elastic body that enhance training and allow a trainee to be focused and comfortable in the training session.

What is claimed is:

1. A kick training belt comprising:

an elastic belt;

a pair of binding tools, said binding tools engaging the opposing ends of said elastic belt, each of said binding tools having two cooperating inflatable air tube members, said inflatable air tube members having hook and loop fasteners thereon, and, a length-adjusting instrument disposed on said elastic belt.

2. A kick training belt as claimed in claim 1, further comprising an exercise counter device.

3. A martial arts practice device comprising an elastic member and a pair of inflatable cuffs, said inflatable cuffs engaging the opposing ends of said elastic member.

4. A martial arts practice device as claimed in claim 1, further comprising an exercise counter device.

* * * * *